US008449071B2

(12) United States Patent
Saito

(10) Patent No.: US 8,449,071 B2
(45) Date of Patent: May 28, 2013

(54) IMAGE FORMING APPARATUS

(75) Inventor: Akira Saito, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 90 days.

(21) Appl. No.: 13/003,905

(22) PCT Filed: Jun. 30, 2009

(86) PCT No.: PCT/JP2009/062265
§ 371 (c)(1),
(2), (4) Date: Jan. 13, 2011

(87) PCT Pub. No.: WO2010/010804
PCT Pub. Date: Jan. 28, 2010

(65) Prior Publication Data

US 2011/0128323 A1 Jun. 2, 2011

(30) Foreign Application Priority Data

Jul. 22, 2008 (JP) ..... 2008-189184

(51) Int. Cl.
*B41J 2/145* (2006.01)
*B41J 2/15* (2006.01)

(52) U.S. Cl.
USPC ..... 347/40; 347/42; 347/49

(58) Field of Classification Search
USPC ..... 347/20, 40, 42, 43, 49
See application file for complete search history.

(56) References Cited

U.S. PATENT DOCUMENTS 5,098,503 A 3/1992 Drake
5,160,945 A * 11/1992 Drake ..... 347/42
5,198,054 A * 3/1993 Drake et al. ..... 156/64
5,581,284 A * 12/1996 Hermanson ..... 347/43
6,350,013 B1 * 2/2002 Scheffelin et al. ..... 347/49
2004/0160475 A1 8/2004 Satoh et al.
2005/0062799 A1 3/2005 Kitahara et al.
2005/0168518 A1 8/2005 Nishino
2009/0174750 A1 7/2009 Saito
2009/0179928 A1 7/2009 Nemoto et al.
2009/0225130 A1 9/2009 Saito

FOREIGN PATENT DOCUMENTS

EP 1186416 A2 3/2002
JP 2004-98473 4/2004
JP 2006-188013 7/2006
JP 2007-21909 2/2007
WO WO2010/063744 A1 6/2010

OTHER PUBLICATIONS

Written Opinion and International Search Report in PCT/JP2009/062265.
Jul. 25, 2011 European search report in connection with counterpart European patent application No. 09 80 0318.

* cited by examiner

*Primary Examiner* — Thinh Nguyen
(74) *Attorney, Agent, or Firm* — Cooper & Dunham LLP

(57) ABSTRACT

An image forming apparatus includes a common array base member; and plural head modules each formed of a module base member and plural heads configured to discharge droplets arranged in an array on the module base member. The plural head modules are attached on the common array base member. The heads of at least two of the head modules discharge liquid droplets of the same color. The at least two of the head modules are positioned relative to a same reference point provided by a reference member on the common array base member.

9 Claims, 22 Drawing Sheets

IMAGE FORMING APPARATUS

TECHNICAL FIELD

The present invention relates to an image forming apparatus, and more specifically, to an image forming apparatus including a recording head for discharging liquid droplets.

BACKGROUND ART

As an image forming apparatus such as a printer, a facsimile, a copier, a plotter, and a multifunction peripheral of these apparatuses, for example, a liquid discharge recording type image forming apparatus using a recording head for discharging ink droplets has been used. As such a liquid discharge recording type image forming apparatus, an inkjet recording apparatus and the like have been known. The liquid discharge recording type image forming apparatus discharges ink droplets from a recording head onto transfer paper (transfer paper is not limited to paper but includes OHP (overhead projector) and anything to which ink droplets and other liquid can attach, which is also referred to as a medium to be recorded, a recording medium, recording paper, a recording sheet, and the like) to form an image (recording and printing an image and text, and imaging mean the same as forming an image). As the liquid discharge recording type image forming apparatus, there are a serial type image forming apparatus having a recording head that discharges liquid droplets to form an image while moving in a horizontal scanning direction, and a line type image forming apparatus having a line type head (line head) which discharges liquid droplets to form an image in a stationary state.

In the present invention, an "image forming apparatus" means an apparatus that performs an image formation by discharging liquid onto a medium such as paper, a string, a fiber, a cloth, leather, a metal, plastic, glass, wood, and ceramics. Moreover, the "image formation" means to attach an image having a meaning such as text and a figure to the medium, and in addition, to attach an image having no meaning such as a pattern to the medium (simply to land liquid droplets on the medium). Further, "ink" is not limited to what is called ink, but is used as a collective term for all liquid capable of being used for image formation, such as those called a recording solution, a fixing processing solution, and liquid. For example, ink includes a DNA sample, a resist, a pattern material, and the like.

As such an image forming apparatus, as described above, there has been known a line type image forming apparatus having a line type recording head in which a nozzle array corresponding to a width of paper to be transferred is arranged. Here, for example, a line type recording head in which plural short heads each having an array of nozzles (nozzle array) for discharging liquid droplets are arranged is used. The plural short heads are arranged in a direction of the nozzle arrays in this line type recording head (this recording head is called a "head module" and the plural head modules arranged together are called a "recording head unit" or a "multi-array head").

In such a head module, the plural heads are required to be positioned with a high precision when arranged in an array. Moreover, in a recording head unit in which plural head modules are arranged, each head module is required to be positioned with a high precision.

In view of the above circumstances, for example, Patent Document 1 discloses a configuration in which a recording head is fixed in a module base by adjusting its position by using a nozzle array direction position adjusting mechanism (taper pin) that also regulates a discharge direction position, and using an inclination adjusting mechanism (eccentric cam), and a configuration where a similar adjustment mechanism is applied for a positional adjustment to fix a head module by a screw, to provide a recording head position adjustment method capable of realizing recording of a high quality image by a method where a positional deviation of an ink in the ejection direction ejected from a nozzle of a recording head is prevented when the adjustment of the position of the recording head is carried out, and the recording head is fixed on the position in the preliminary fixing.

[Patent Document 1] Japanese Patent Application Publication No. 2006-188013

Further, Patent Document 2 discloses a configuration to reduce a positional change of a discharging outlet caused by thermal expansion of a thermal type head serving as a long head.

[Patent Document 2] Japanese Patent Application Publication No. 2004-098473

In the case of forming a line head by using a head module in which plural heads are arranged, in general, one head module is formed by arranging two arrays of plural heads in a staggered manner to discharge one line of liquid droplets of the same color. A recording head unit is formed by positioning and fixing each head module with respect to a predetermined reference.

However, in the recording head unit in which plural head modules each having plural heads are arranged, it is difficult to replace each head. Therefore, it is preferable that the replacement can be performed on a head module by head module basis, that is, on a head module level.

However, for example, in the case where one head module is formed by arranging plural (ten) heads for discharging liquid droplets of the same color in a staggered manner, and one of the heads having a defect is required to be replaced, the remaining non-defective nine heads, ink and electric connecting components for the ten heads, and the like have to be thrown away because of the one defective head. As a result, high cost is required for the replacement.

In view of this, the head module, in which plural heads for discharging liquid droplets of the same color are arranged in a staggered manner, is divided into two so that one head module is formed of one array of heads. Consequently, the number of heads to be replaced, and the ink and electric connecting components attached to the heads to be replaced are reduced to half, thereby cost required for the replacement can be reduced.

In the case where the plural heads for discharging ink of the same color are divided to be arranged on two head modules, however; the two head modules are required to be positioned with a high precision on a base member (referred to as an array base member) that is commonly used for the two head modules. That is, when all of the plural heads for discharging the liquid droplets of the same color are arranged on one base member (this is referred to as a "module base member"), each of the plural heads can be positioned with a high precision by positioning by utilizing an image processing method and the like. However, when the plural heads are divided and arranged in the two head modules, such a positioning by the image processing method cannot be performed in order to make it easier to perform replacement in the head module level, that is, on the head module by head module basis.

Furthermore, even in the case of using a line type head formed of one head having a nozzle array of one line instead of using a head module in which plural heads are arranged, when plural line heads are arranged to form a recording head unit, it is important to position the two line heads on the common array base member with a high precision to form a high quality image, in such a case where at least two line heads arranged in a paper transfer direction discharge liquid droplets of the same color to enhance a pixel density.

In the conventional configuration, however, when two or more head modules or heads are set to discharge liquid droplets of the same color and each of the head modules or heads is replaced (that is, when replacement is performed in the head module level or the head level), reproducibility of the positional precision has been poor.

DISCLOSURE OF INVENTION

The present invention has been made in view of the above-described problems, and it is an object of at least one embodiment of the present invention to make it possible to position plural head modules or plural heads with a high precision and to perform replacement on a head module by head module basis or a head by head basis, that is, in the head module level or the head level.

According to one aspect of the present invention, an image forming apparatus includes a common array base member; and plural head modules each formed of a module base member and plural heads configured to discharge droplets arranged in an array on the module base member. The plural head modules are attached on the common array base member. The heads of at least two of the head modules discharge liquid droplets of the same color. The at least two of the head modules are positioned relative to a same reference point provided by a reference member on the common array base member.

According to another aspect of the present invention, an image forming apparatus includes a common array base member; and plural heads configured to discharge liquid droplets and attached on the common array base member. At least two of the heads arranged in a paper transfer direction discharge liquid droplets of the same color. The at least two of the heads are positioned relative to a same reference point provided by a reference member on the common array base member.

BEST MODE FOR CARRYING OUT THE INVENTION

Figure 1:
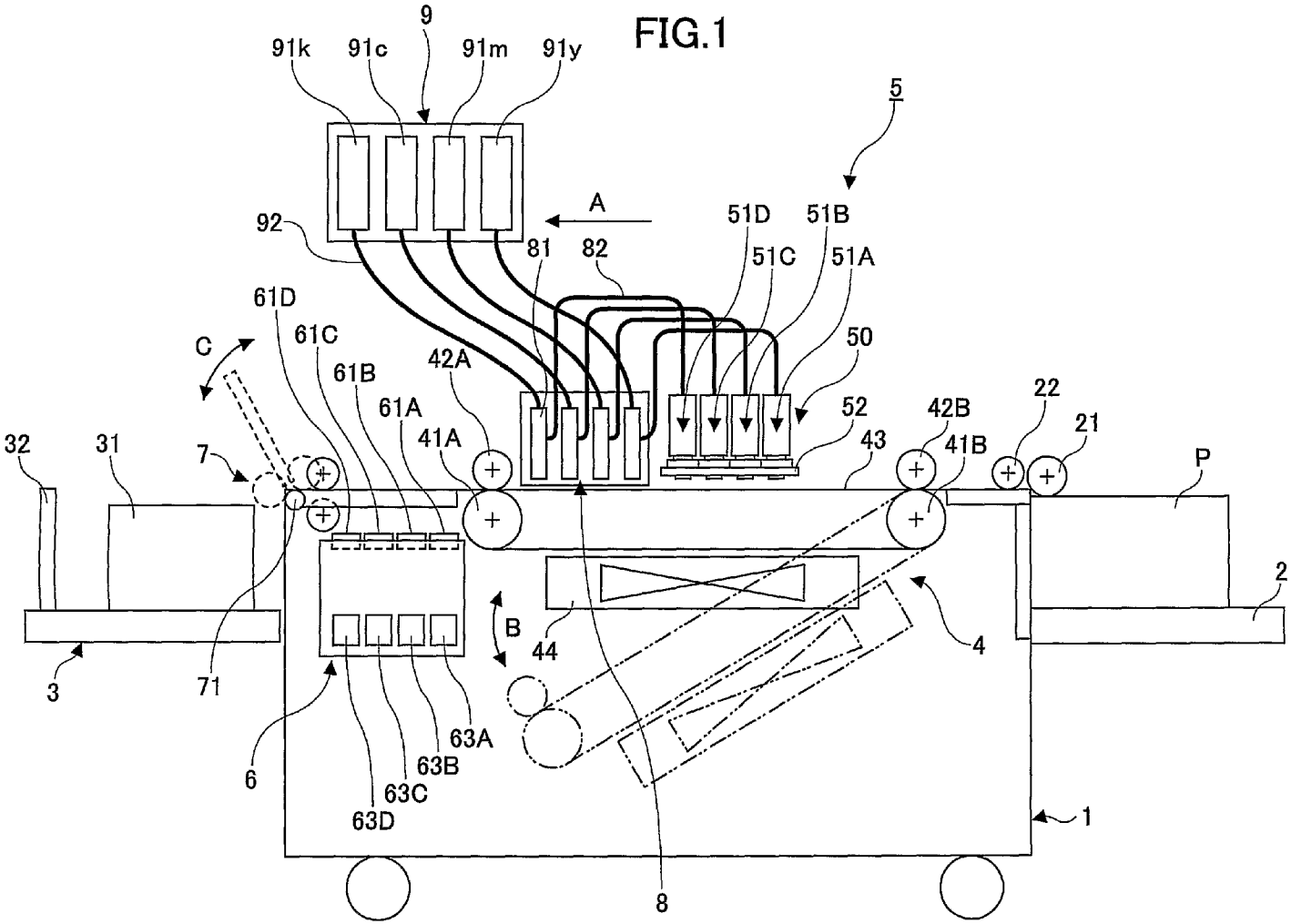
FIG. 1 is a side schematic diagram for describing an entire configuration of an example of an image forming apparatus of the present invention.
Figure 2:
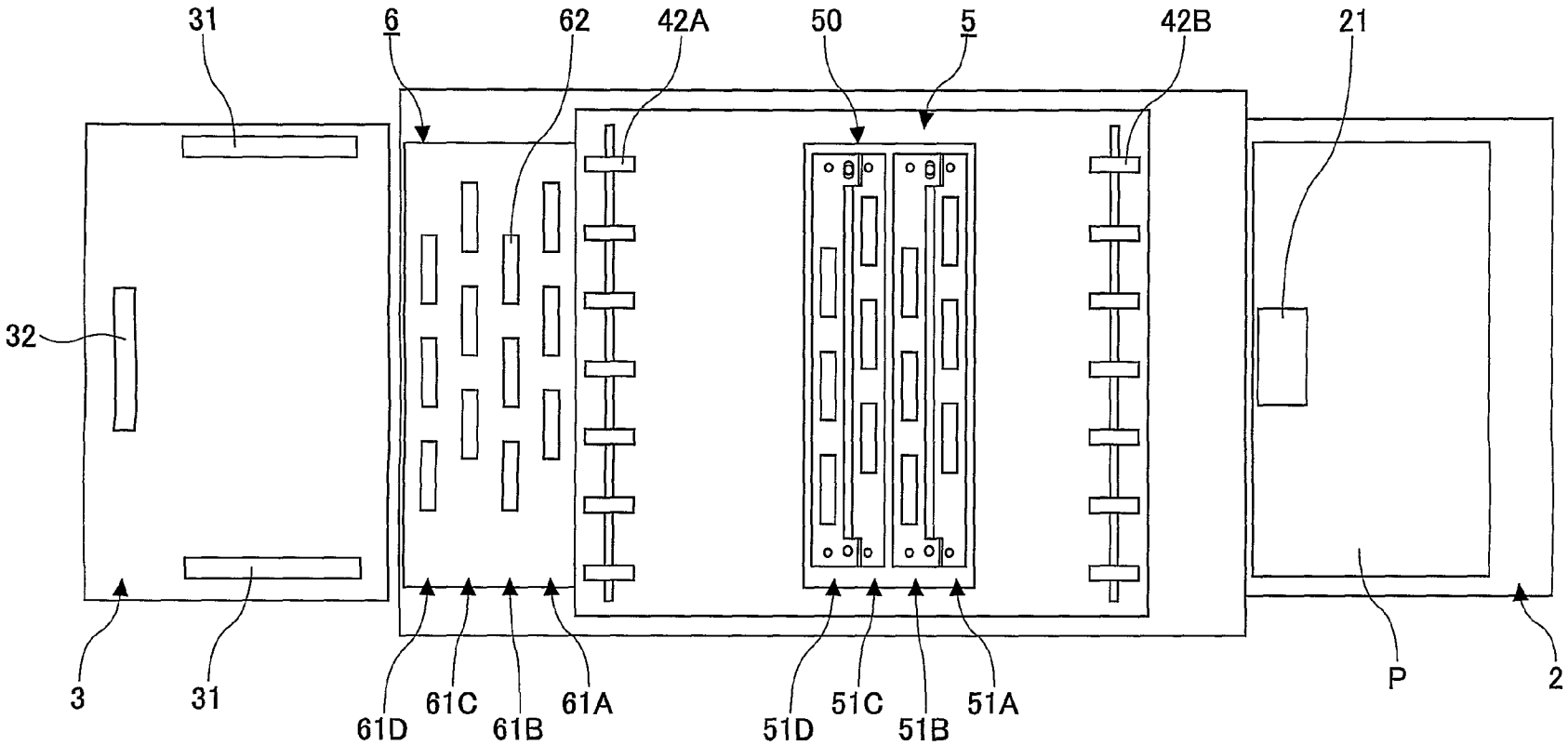
FIG. 2 is a plan diagram showing a substantial part of the image forming apparatus.

Embodiments of the present invention are described below with reference to the drawings. First, an example of an image forming apparatus according to the present invention is described with reference to FIGS. 1 and 2. FIG. 1 is a schematic configuration diagram for describing an entire configuration of the image forming apparatus. FIG. 2 is a schematic plan diagram of the image forming apparatus shown in FIG. 1.

The image forming apparatus shown in FIG. 1 is a line type image forming apparatus. This line type image forming apparatus includes an apparatus body 1; a paper feed tray 2 on which paper P is stacked to be fed; a paper output tray 3 on which printed paper P is outputted and stacked; a transfer unit 4 for transferring the paper P from the paper feed tray 2 to the paper output tray 3; an image forming unit 5 which includes head modules 51A to 51D of the present invention and performs printing by discharging liquid droplets onto the paper P transferred by the transfer unit 4; a cleaning apparatus 6 serving as a maintenance and recovery mechanism for maintaining and recovering each recording head of the image forming unit 5 at a required timing or after the printing; a transfer guide part 7 for opening and closing the cleaning apparatus 6; an ink tank unit 8 for supplying ink to the head modules 51A to 51D of the image forming unit 5; and a main tank unit 9 for supplying ink to the ink tank unit 8.

The apparatus body 1 is formed of front, back, and side boards, a stay, and the like which are not shown. The paper P stacked on the paper feed tray 2 is fed by a pick-up roller 21 and a paper feed roller 22 to the transfer unit 4 one by one.

The transfer unit 4 includes a transfer driving roller 41A, a transfer follower roller 41B, and an endless transfer belt 43 wrapped around the transfer driving roller 41A and the transfer follower roller 41B. Plural holes (not-shown) are formed on the surface of the transfer belt 43 and a suction fan 44 for sucking the paper P is provided under the transfer belt 43. Further, transfer guide rollers 42A and 42B are held by guides (not shown) over the transfer driving roller 41A and the transfer follower roller 41B, respectively, and contact the transfer belt 43 under their own weight.

The transfer belt 43 is rotated by the transfer driving roller 41A which is rotated by a motor which is not shown. The paper P is sucked by the suction fan 44 onto the transfer belt 43 and transferred by the rotation of the transfer belt 43. The transfer follower roller 41B, and the transfer guide rollers 42A and 42B are rotated by following the transfer belt 43.

The image forming unit 5 formed of the head modules 51A to 51D for discharging liquid droplets to be printed on the paper P is provided over the transfer unit 4 so as to be movable in a direction of an arrow A (and a reverse direction). The image forming unit 5 is moved to above the cleaning apparatus 6 in a maintenance and recovery operation (cleaning operation) and returned to the position shown in FIG. 1 in the case of image formation.

The image forming unit 5 includes a recording head unit 50 in which the head modules 51A, 51B, 51C, and 51D are arranged in an array in a paper transfer direction on an array base member 52. Each of the head modules 51A to 51D has an array of plural heads each including two arrays of plural nozzles for discharging liquid droplets. Here, one of the two nozzle arrays of each head of the head modules 51A and 51B discharges yellow (Y) liquid droplets while the other nozzle array of each head of the head modules 51A and 51B discharges magenta (M) liquid droplets. Further, one of the two nozzle arrays of each of the head modules 51C and 51D discharges cyan (C) liquid droplets and the other nozzle array of each head of the head modules 51C and 51D discharges black (K) liquid droplets.

That is, in the recording head unit 50 of the image forming unit 5, two head modules 51 for discharging liquid droplets of the same colors are arranged in the paper transfer direction so that the nozzle arrays of the two head modules 51 constitute a nozzle array of one line corresponding to a paper width.

Ink tanks 81 (a reference number is given to only one ink tank for simplifying the drawing) of the ink tank unit 8 are provided on an upstream side of the image forming unit 5. Ink in the ink tanks 81 is supplied through supply tubes 82 to the head module units 51A to 51D. The water head differences between the ink in the ink tanks 81 and the head modules 51 cause negative pressures with respect to each head of the head modules 51A to 51D. The ink tank unit 8 is provided so as to be movable with the image forming unit 5 in the direction of the arrow A. The supply tubes 82 connecting the ink tanks 81 and the head modules 51 are drawn as being connected to the top surfaces of the head modules 51A to 51D to simplify the drawing. However, in actuality, the supply tubes 82 are connected to end parts of the head modules 51A to 51D in a longitudinal direction (a direction perpendicularly crossing the paper transfer direction).

Further, the main tank unit 9 is provided on an upstream side of the ink tanks 81. Main tanks 91 in the main tank unit 9 supply ink through supply tubes 92 to the ink tanks 81.

The transfer guide part 7 for outputting the paper P to the paper output tray 3 is provided on a downstream side of the transfer unit 4. The paper P guided by the transfer guide part 7 to be transferred is outputted to the paper output tray 3. The paper output tray 3 has a pair of side walls 31 for regulating a width direction of the paper P and an end wall 32 for regulating a leading end of the paper P.

The maintenance and recovery mechanism (cleaning apparatus) 6 includes four arrays of cleaning units 61A to 61D corresponding to the head modules 51A to 51D of the image forming unit 5. One cleaning unit 61 is formed of cap members 62 and a wiper member which is not shown, and the like, corresponding to each head of the head module 51. The cap members 62 of the cleaning unit 61 can be independently moved up and down per array. Further, suction pumps 63A to 63D are provided below the cleaning unit 61 to suck ink from the nozzles of the head modules 51 while capping the nozzle surfaces of the head modules 51 with the cap members 62.

In this image forming apparatus, the case of capping the nozzle surfaces of the heads of the head modules 51A to 51D with the cleaning units 61A to 61D after the printing to suck ink from the nozzles, and the case of cleaning the ink attached to the nozzle surface of the heads of the head modules 51 with the wiper member are described. In these cases, after the printing is stopped, the entire transfer unit 4 is pivoted in a downward direction of an arrow B by using the transfer follower roller 41B as a supporting point, thereby a space between the image forming unit 5 and the transfer unit 4 is enlarged so as to obtain a space for the image forming unit 5 to move, as shown in FIG. 1. At this time, the transfer guide part 7 provided over the cleaning apparatus 6 is also pivoted in an upward direction of an arrow C, thereby an upper part of the cleaning apparatus 6 is opened.

After the transfer unit 4 and the transfer guide part 7 are opened (released), the image forming unit 5 moves in the paper transfer direction (direction of the arrow A) and stops above the cleaning apparatus 6, where the cleaning units 61A to 61D are elevated to start cleaning operations (maintenance and recovery operations) of the head modules 51A to 51D.

Figure 3:
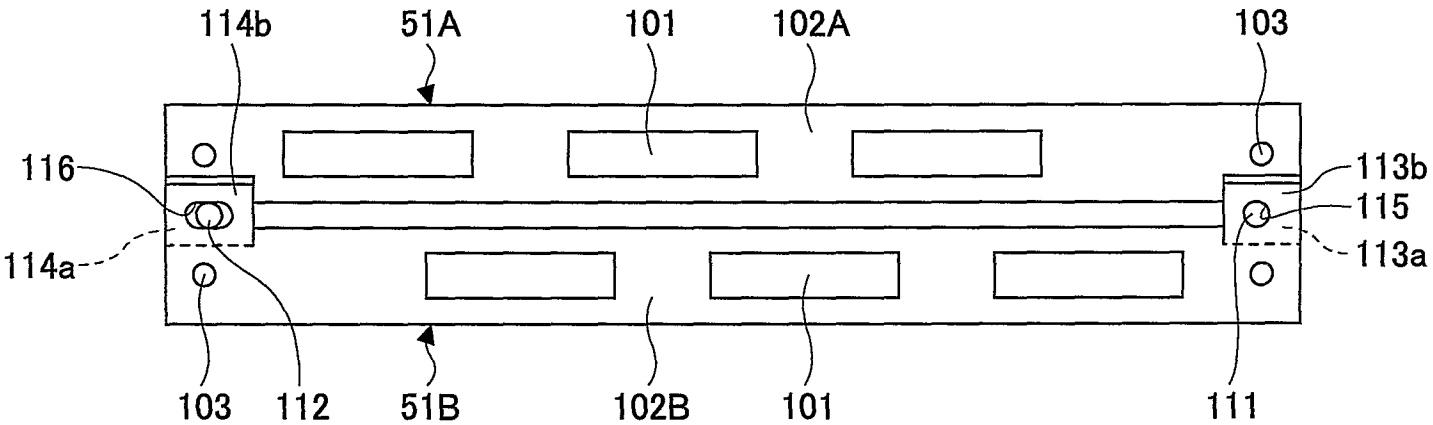
FIG. 3 is a schematic plan diagram showing a substantial part of a recording head unit, for describing a first embodiment of the present invention.
Figure 4:
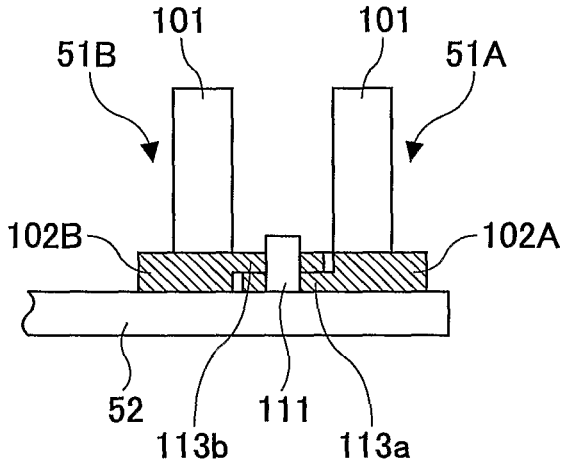
FIG. 4 is an enlarged side cross-sectional diagram of the recording head unit shown in FIG. 3.

Next, a first embodiment of the present invention is described with reference to FIGS. 3 and 4. FIGS. 3 and 4 are a schematic plan diagram and an enlarged side cross-sectional diagram of a substantial part of a recording head unit, respectively, for describing the first embodiment.

Figure 23:
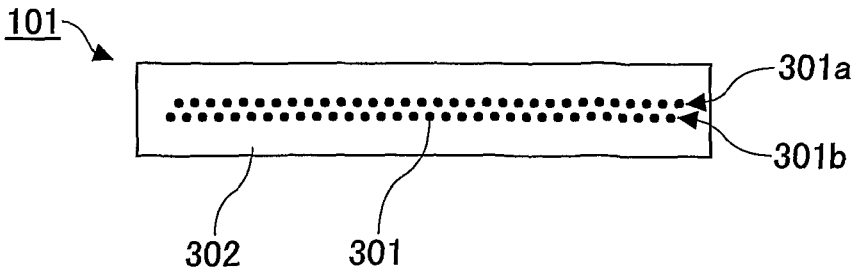
FIG. 23 is a diagram showing an example of a head of each embodiment.

As described above, in the head modules 51A and 51B, plural heads 101 (three in this example, but two, four, or more heads 101 may be employed) each having two arrays of plural nozzles for discharging liquid droplets are positioned with a high precision on module base members 102A and 102B. One nozzle array of each of the heads 101 of the head module 51A and one nozzle array of each of the heads 101 of the head module 51B constitute one line of nozzle arrays for discharging liquid droplets of the same color. As shown in FIG. 23, the head 101 has, on a nozzle board 302, nozzle arrays 301*a* and 301*b* which are two arrays of plural nozzles 301 for discharging liquid droplets.

The module base members 102A and 102B of the head modules 51A and 51B are fixed on the common array base member 52 by fastening members (such as screws) which are not shown, through module fixing holes 103 provided on end part sides in a longitudinal direction (a direction of the array of the heads 101) of the module base members 102A and 102B.

Here, on the array base member 52, positioning pin members 111 and 112 are provided as reference members corresponding to opposite end parts in the longitudinal direction of the head modules 51A and 51B.

In opposite end parts of the module base members 102A and 102B of the head modules 51A and 51B, overlapped parts 113*a* and 113*b*, and 114*a* and 114*b* which are overlapped with each other in a direction of the axes of the positioning pin members 111 and 112 are formed respectively. A positioning hole 115 in which the positioning pin member 111 is fit is formed in the overlapped parts 113*a* and 113*b*, while a positioning hole 116 in an elongated hole shape in which the positioning pin member 112 is fit is formed in the overlapped parts 114*a* and 114*b*.

Therefore, the head modules 51A and 51B for discharging droplets of the same colors are positioned on the array base member 52 by the same positioning pin members 111 and 112. Accordingly, a positional relationship between the head modules 51A and 51B can be adjusted with a high precision without depending on positional precisions of the positional pin members 111 and 112.

As a result, a positional precision can be reproduced even when one of the head modules is removed. Thus, plural heads for discharging liquid droplets of the same color can be divided to be arranged in two head modules and replaced on a head module by head module basis, that is, in a head module level.

In this manner, by positioning the head modules for discharging liquid droplets of the same color by using the same reference member on the base array member, the plural head modules can be positioned with a high precision without being influenced by a positioning precision of the reference member.

Figure 5:
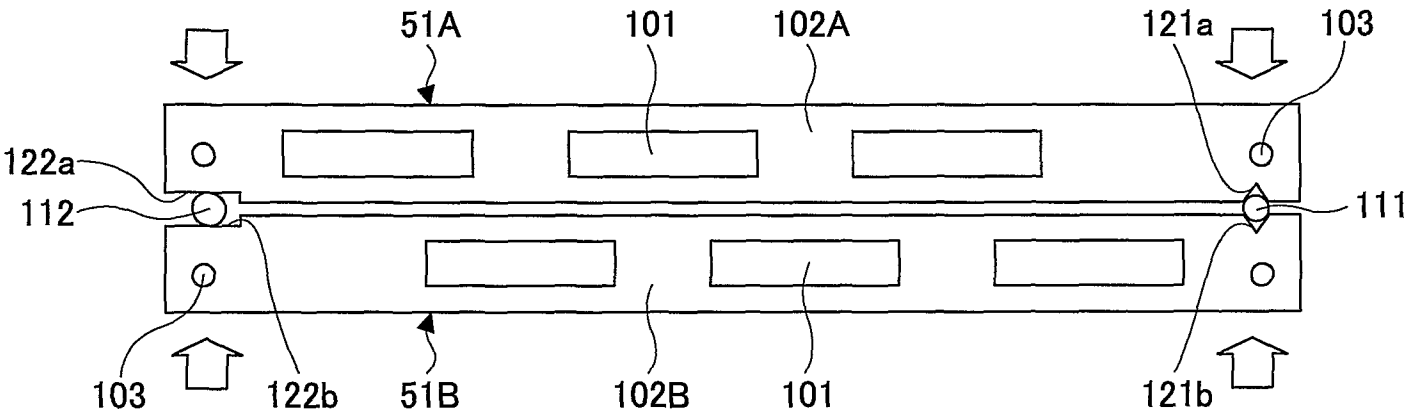
FIG. 5 is a schematic plan diagram showing a substantial part of a recording head unit, for describing a second embodiment of the present invention.
Figure 6:
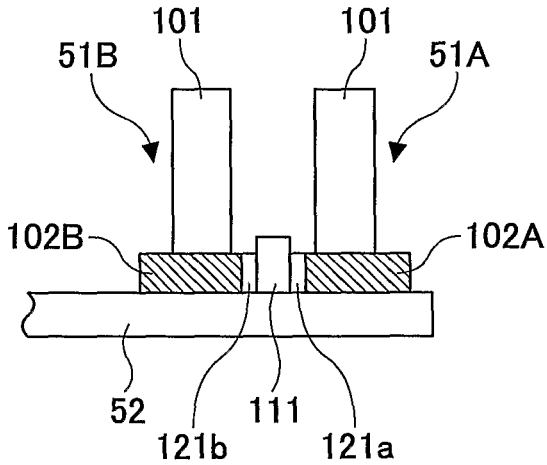
FIG. 6 is an enlarged side cross-sectional diagram of the recording head unit shown in FIG. 5.

Next, a second embodiment of the present invention is described with reference to FIGS. 5 and 6. FIGS. 5 and 6 are a schematic plan diagram and an enlarged side cross-sectional diagram of a substantial part of a recording head unit, respectively, for describing the second embodiment.

In this embodiment, one end face perpendicular to the paper transfer direction of one of the opposite end parts of the module base member 102A of the head module 51A has a substantially V-shaped positioning groove 121*a* in a planar shape, and one end face perpendicular to the paper transfer direction of one of the opposite end parts of the module base member 102B of the head module 51B has a substantially V-shaped positioning groove 121*b* in a planar shape. The V-shaped positioning grooves 121*a* and 121*b* contact the positioning pin member 111 in directions of hollow arrows. One end face perpendicular to the paper transfer direction of the other opposite end part of the module base member 102A has a notch-shaped positioning recession part 122*a*, and one end face perpendicular to the paper transfer direction of the other opposite end part of the module base member 102B has a notch-shaped positioning recession part 122*b*. The notch-shaped positioning recession parts 122*a* and 122*b* contact the positioning pin member 112 in directions of hollow arrows in FIG. 5.

The module base members 102A and 102B are biased in the directions of the hollow arrows in FIG. 5 by a biasing member which is not shown (such as a spring member and an elastic member) so that the V-shaped positioning grooves 121*a* and 121*b*, and the positioning recession parts 122*a* and 122*b* are pressed to contact the positioning pin members 111 and 112, respectively.

Accordingly, one of the head modules 51A and 51B can be replaced without removing the other one.

That is, in the configuration of the first embodiment, for example, the head modules 51A and 51B are positioned by fitting the positioning pin members 111 and 112 into the holes of the module base members 102A and 102B. Therefore, when the head module (head module 51A in the above example) having the overlapped part situated on a bottom side is replaced, it cannot be replaced unless the head module (head module 51B in the above example) having the overlapped part situated on the top side is removed. On the contrary, in this embodiment, either of the head modules 51A and 51B can be independently removed. Therefore, it becomes easier to remove the head modules.

Figure 7:
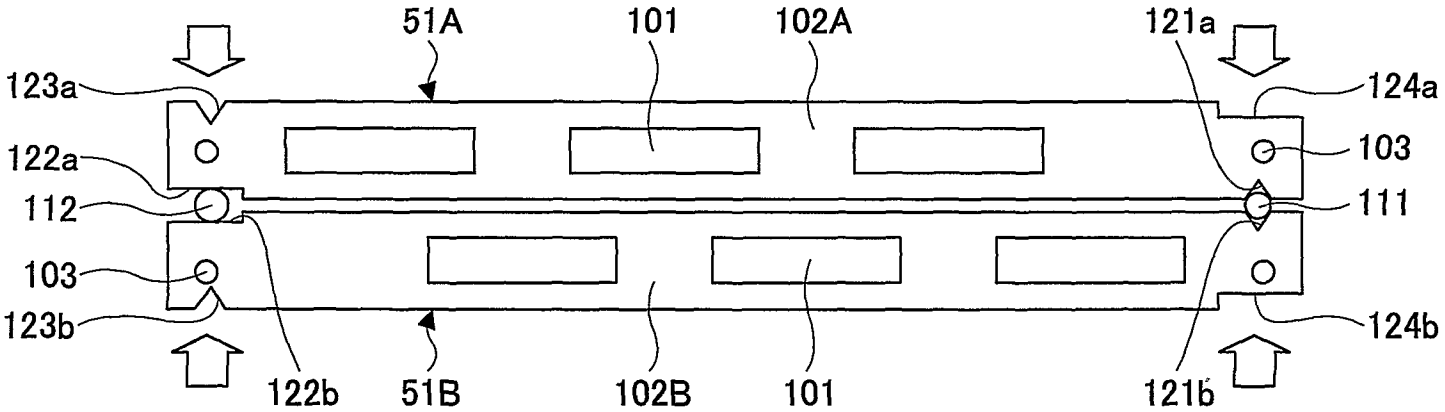
FIG. 7 is a schematic plan diagram showing a substantial part of a recording head unit, for describing a third embodiment of the present invention.
Figure 8:
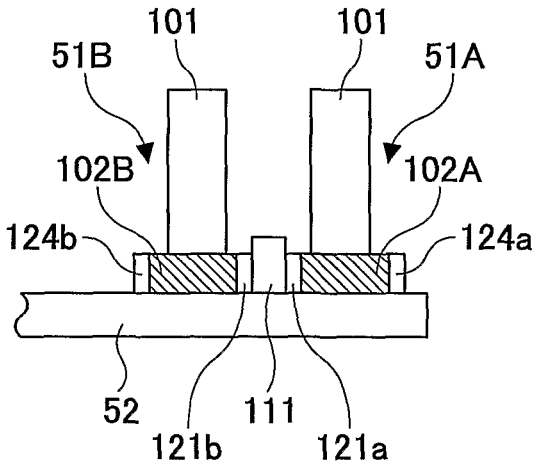
FIG. 8 is an enlarged side cross-sectional diagram of the recording head unit shown in FIG. 7.

Next, a third embodiment of the present invention is described with reference to FIGS. 7 and 8. FIGS. 7 and 8 are a schematic plan diagram and an enlarged side cross-sectional diagram of a substantial part of a recording head unit, respectively, for describing this embodiment.

In this embodiment, in a similar manner to embodiment 2, one end face perpendicular to the paper transfer direction of one of the opposite end parts of the module base member 102A of the head module 51A has the substantially V-shaped positioning groove 121*a* in a planar shape, and one end face perpendicular to the paper transfer direction of one of the opposite end parts of the module base member 102B of the head module 51B has a substantially V-shaped positioning groove 121*b* in a planar shape. The V-shaped positioning grooves 121*a* and 121*b* contact the positioning pin member 111 in directions of hollow arrows. One end face perpendicular to the paper transfer direction of the other opposite end part of the module base member 102A has a notch-shaped positioning recession part 122*a*, and one end face perpendicular to the paper transfer direction of the other opposite end part of the module base member 102B has a notch-shaped positioning recession part 122*b*. The positioning recession parts 122*a* and 122*b* contact the positioning pin member 112 in directions of hollow arrows. Meanwhile, the other end face perpendicular to the paper transfer direction of the opposite end part having the V-shaped positioning groove 121*a* has a positioning recession part 124*a*, and the other end face perpendicular to the paper transfer direction of the opposite end part having the V-shaped positioning groove 121*b* has a positioning recession part 124*b*. The other end face perpendicular to the paper transfer direction of the opposite end part having the positioning recession part 122*a* has a V-shaped positioning groove 123*a*, and the other end face perpendicular to the paper transfer direction of the opposite end part having the positioning recession part 122*b* has a V-shaped positioning groove 123*b*.

Here, the V-shaped positioning grooves 121*a* and 123*a* of the module base member 102A are positioned on opposite sides to each other in the longitudinal direction. In the same manner, the positioning recession parts 122*a* and 124*a* are positioned on the opposite sides to each other in the longitudinal direction. In a similar manner, the V-shaped positioning grooves 121*b* and 123*b* of the module base member 102B are positioned on the opposite sides to each other in the longitudinal direction. In the same manner, the positioning recession parts 122*b* and 124*b* are positioned on the opposite sides to each other in the longitudinal direction.

Accordingly, each of the module base members 102A and 102B has the same shape when turned over and rotated by 180°. Therefore, the same module base members can be used for the plural head modules 51.

Figure 9:
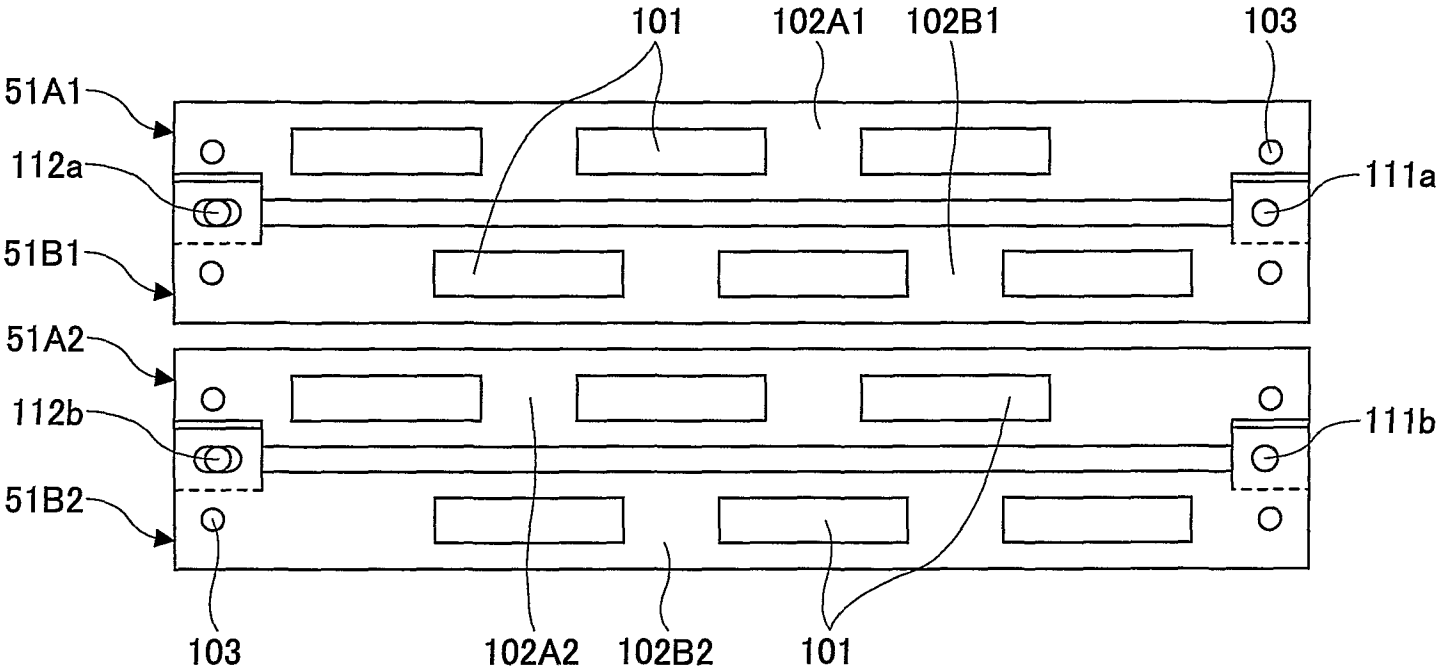
FIG. 9 is a schematic plan diagram of a recording head unit for describing a fourth embodiment of the present invention.
Figure 10:
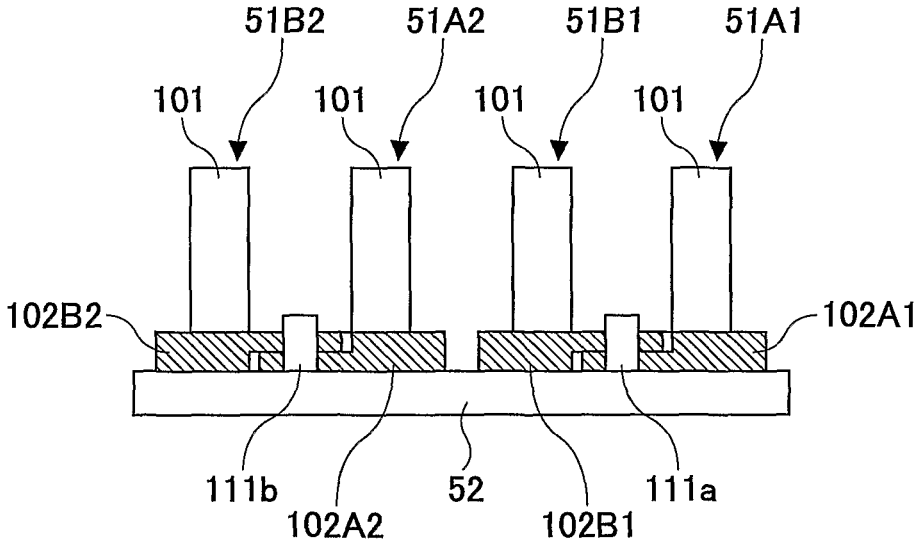
FIG. 10 is an enlarged side cross-sectional diagram of the recording head unit shown in FIG. 9.

Next, a fourth embodiment of the present invention is described with reference to FIGS. 9 and 10. FIGS. 9 and 10 are a schematic plan diagram and an enlarged side cross-sectional diagram of a recording head unit, respectively, for describing the fourth embodiment. For the simplicity of the drawings, the positioning holes of the module base members are not provided with reference numbers; however, they are similar to those in the first embodiment (the same applies to the following embodiments).

In this embodiment, four head modules 51A1, 51B1, 51A2, and 51B2 for discharging liquid droplets of the same color are arranged in the paper transfer direction.

In this case, the head modules 51A1 and 51B1 are positioned by positioning pin members 111*a* and 112*a* serving as the same reference members to be arranged on the array base member 52. The head modules 51A2 and 51B2 are positioned by positioning members 111*b* and 112*b* serving as the same reference members to be arranged on the array base member 52. The head modules 51A2 and 51B2 have nozzle positions each displaced by a ½ nozzle pitch (nozzle interval) in a direction of the nozzle array, with respect to nozzle positions of the head modules 51A1 and 51B1, respectively.

Accordingly, recording can be performed with a resolution twice as high as the case of using two head modules.

Figure 11:
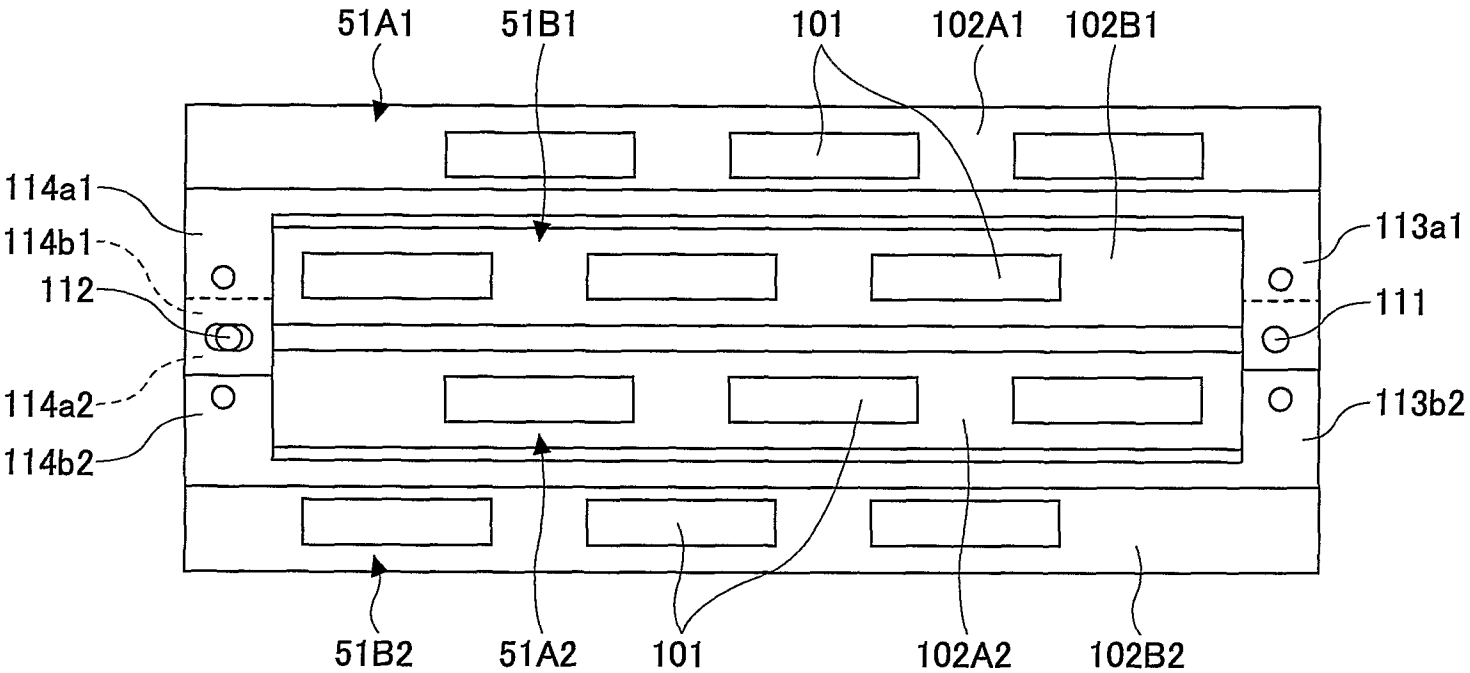
FIG. 11 is a schematic plan diagram of a recording head unit for describing a fifth embodiment of the present invention.
Figure 12:
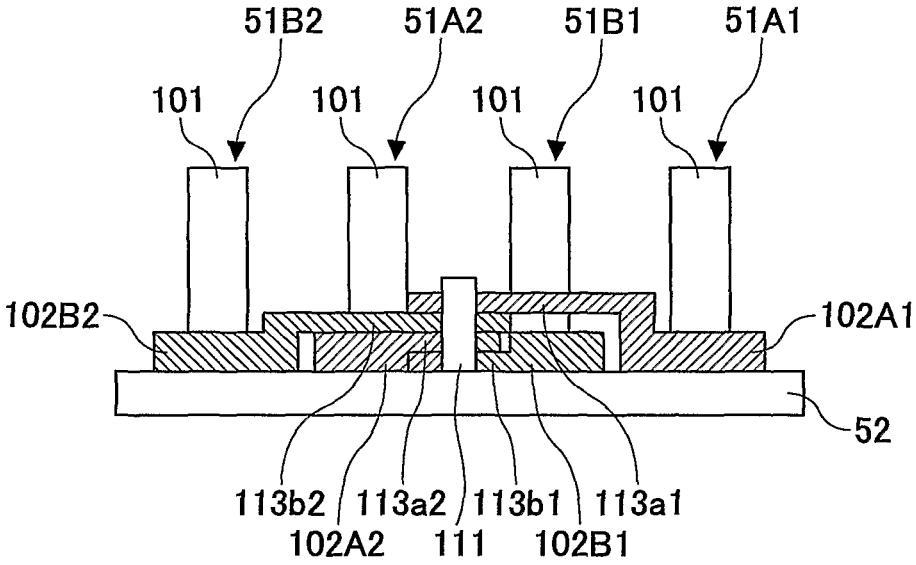
FIG. 12 is an enlarged side cross-sectional diagram of the recording head unit shown in FIG. 11.

Next, a fifth embodiment of the present invention is described with reference to FIGS. 11 and 12. FIGS. 11 and 12 are a schematic plan diagram and an enlarged side cross-sectional diagram of a recording head unit, respectively, for describing the fifth embodiment.

In this embodiment, the four head modules 51A1, 51B1, 51A2, and 51B2 for discharging liquid droplets of the same color are arranged in the paper transfer direction in a similar manner to the fourth embodiment.

Here, overlapped parts 113*a*1, 113*b*1, 113*a*2, and 113*b*2, and overlapped parts 114*a*1, 114*b*1, 114*a*2, and 114*b*2 are formed in an integrated manner in opposite end parts of the module base members 102A1, 102B1, 102A2, and 102B2 of the modules 51A1, 51B1, 51A2, and 51B2. The overlapped parts 113*a*1, 113*b*1, 113*a*2, and 113*b*2 are set so that the positioning pin member 111 provided on the array base member 52 fit into positioning reference holes formed in the overlapped parts 113*a*1, 113*b*1, 113*a*2, and 113*b*2, and the overlapped parts 114*a*1, 114*b*1, 114*a*2, and 114*b*2 are set so that the positioning pin member 112 provided on the array base member 52 fit into positioning reference holes formed in the overlapped parts 114*a*1, 114*b*1, 114*a*2, and 114*b*2. In this manner, the modules 51A1, 51B1, 51A2, and 51B2 are positioned by the common positioning pin members 111 and 112.

With the above-described configuration, the head modules 51A1, 51B1, 51A2, and 51B2 for discharging liquid droplets of the same color can be positioned with a higher precision than the fourth embodiment.

Figure 13:
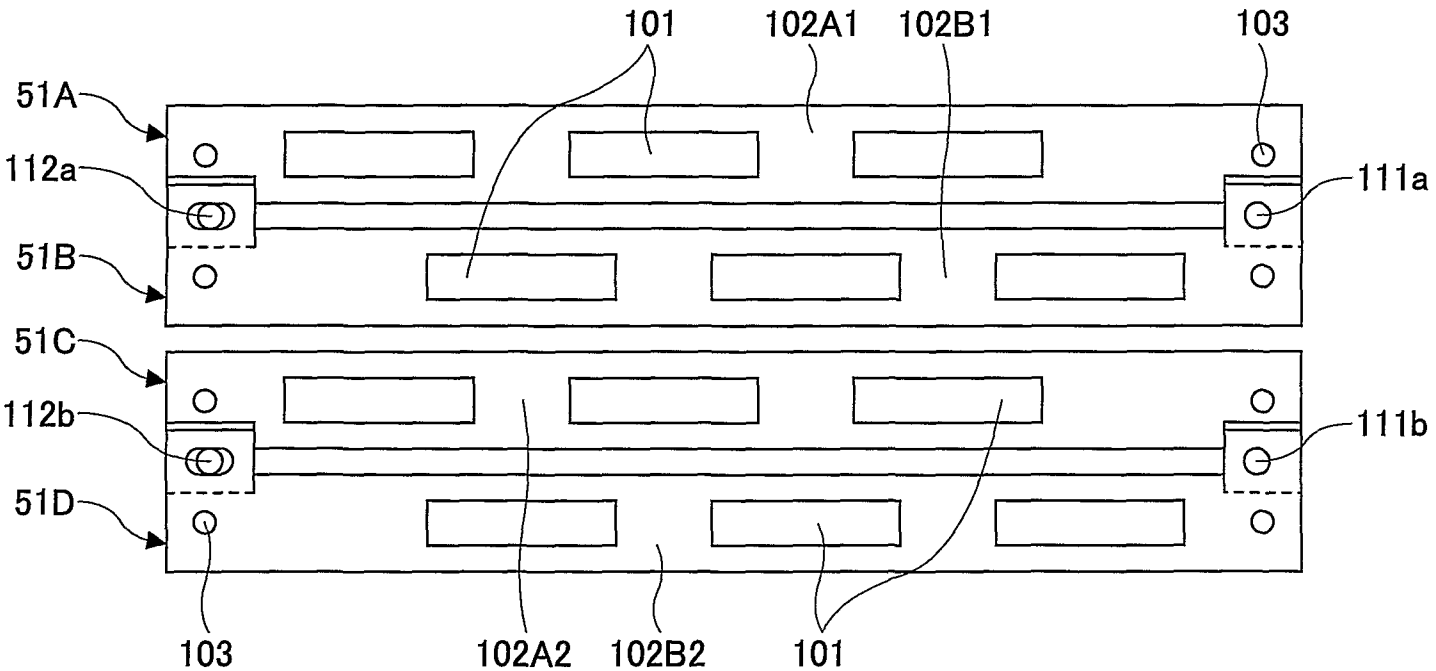
FIG. 13 is a schematic plan diagram of a recording head unit for describing a sixth embodiment of the present invention.
Figure 14:
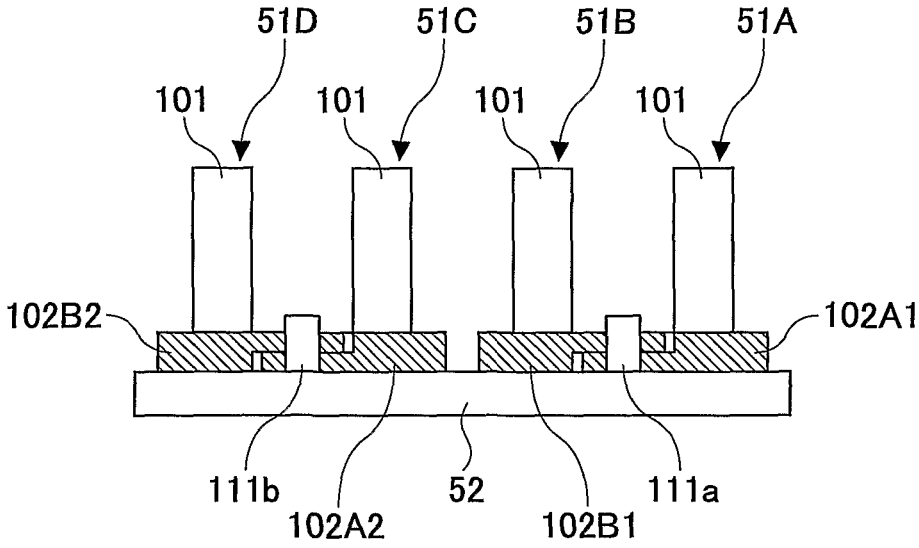
FIG. 14 is an enlarged side cross-sectional diagram of the recording head unit shown in FIG. 13.

Next, a sixth embodiment of the present invention is described with reference to FIGS. 13 and 14. FIGS. 13 and 14 are a schematic plan diagram and an enlarged cross-sectional diagram of a recording head unit, respectively, for describing the sixth embodiment.

In this embodiment, in a configuration similar to that of the fourth embodiment, the two head modules 51A and 51B on the upstream side serve as head modules for discharging liquid droplets of the same colors, while the two head modules 51C and 51D on the downstream side serve as head modules for discharging liquid droplets of the same colors. The colors of the liquid droplets discharged by the head modules 51A and 51B, and the colors of the liquid droplets discharged by the head modules 51C and 51D are different from each other (the same configuration as described in the configuration of FIGS. 1 and 2).

Figure 15:
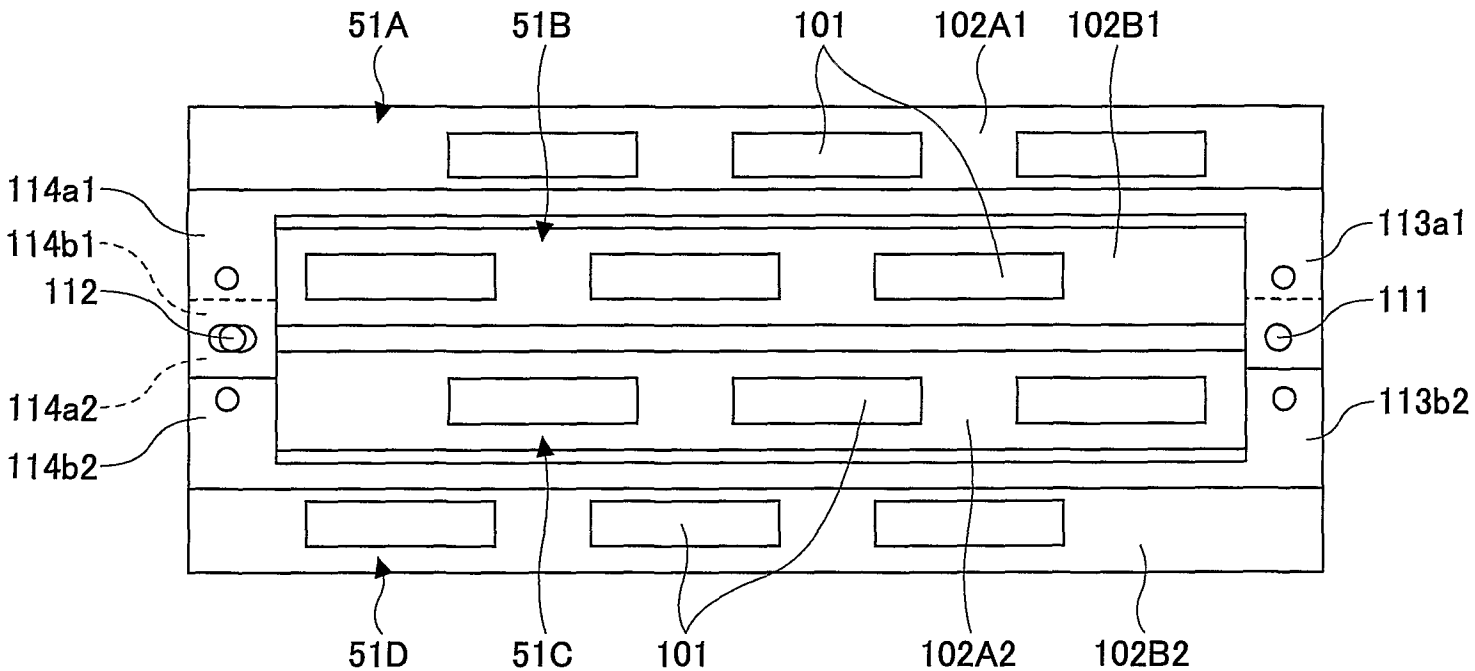
FIG. 15 is a schematic plan diagram of a recording head unit for describing a seventh embodiment of the present invention.
Figure 16:
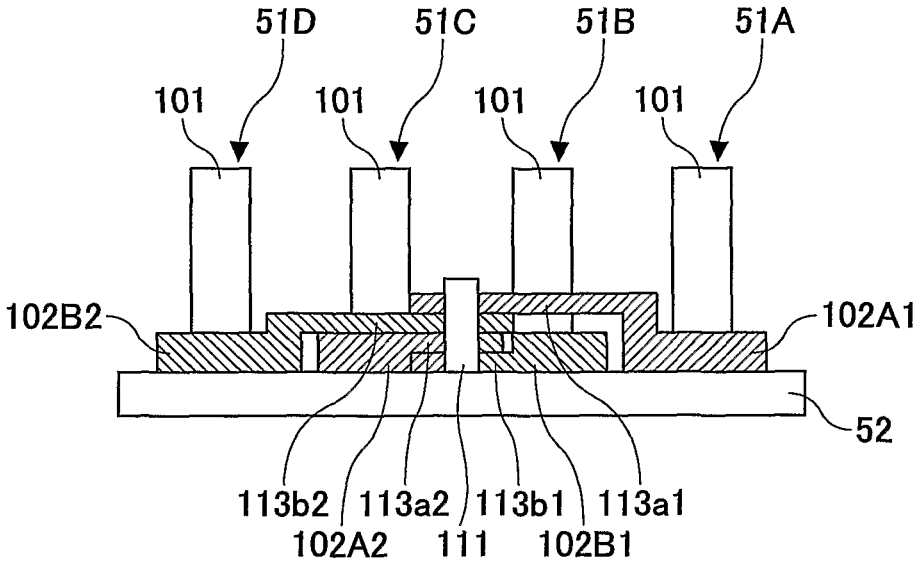
FIG. 16 is an enlarged side cross-sectional diagram of the recording head unit shown in FIG. 15.

Next, a seventh embodiment of the present invention is described with reference to FIGS. 15 and 16. FIGS. 15 and 16 are a schematic plan diagram and an enlarged side cross-sectional diagram of a recording head unit, respectively, for describing the seventh embodiment.

In this embodiment, in a configuration similar to that of the fifth embodiment, the two head modules 51A and 51B on the upstream side serve as head modules for discharging liquid droplets of the same colors, while the two head modules 51C and 51D on the downstream side serve as head modules for discharging liquid droplets of the same colors. The colors of the liquid droplets discharged by the head modules 51A and 51B, and the colors of the liquid droplets discharged by the head modules 51C and 51D are different from each other.

These four head modules 51A, 51B, 51C, and 51D are positioned by the positioning pin members 111 and 112 serving as common reference members to be arranged on the array base member 52.

Figure 17:
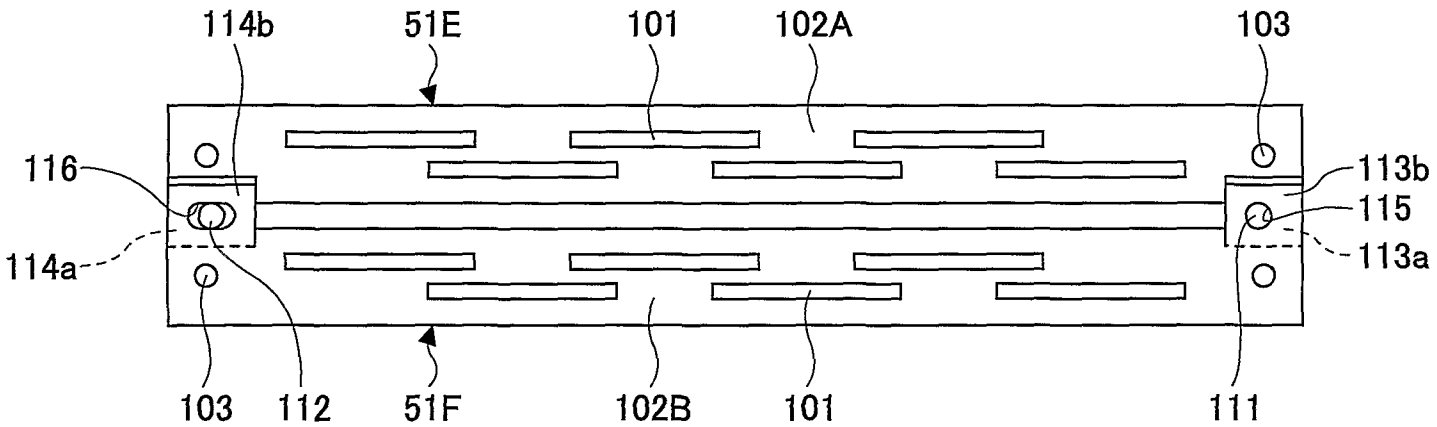
FIG. 17 is a schematic plan diagram of a recording head unit for describing an eighth embodiment of the present invention.
Figure 18:
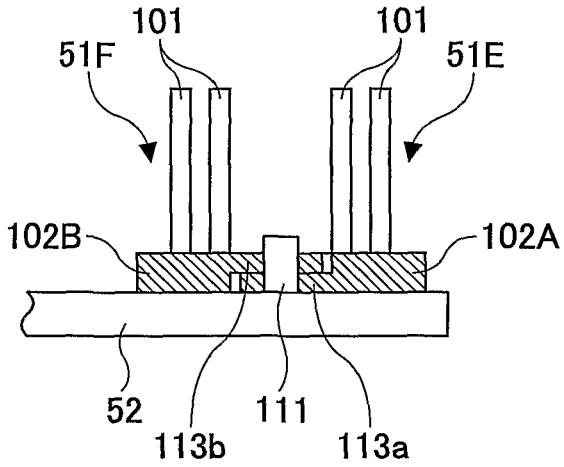
FIG. 18 is an enlarged side cross-sectional diagram of the recording head unit shown in FIG. 17.

Next, an eighth embodiment of the present invention is described with reference to FIGS. 17 and 18. FIGS. 17 and 18 are a schematic plan diagram and an enlarged side cross-sectional diagram of a recording head unit, respectively, for describing the eighth embodiment.

In this embodiment, plural heads 101 are arranged in a staggered manner on each of head modules 51E and 51F for discharging liquid droplets of the same color, so that one head module has nozzle arrays corresponding to one line. A configuration for positioning the two head modules 51E and 51F is similar to that of the head modules 51A and 51B described in the first embodiment.

Figure 19:
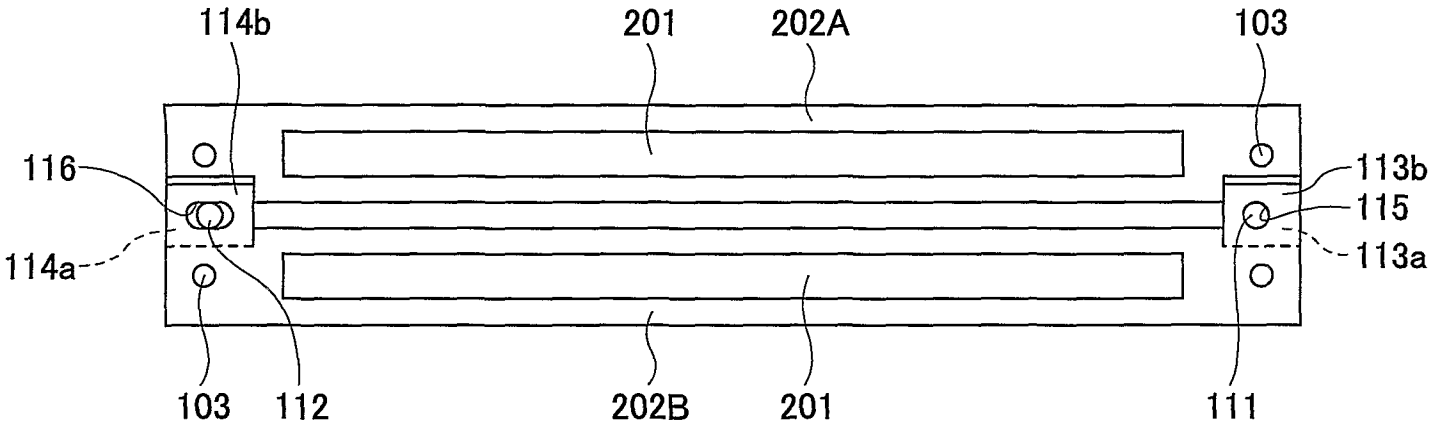
FIG. 19 is a schematic plan diagram showing a substantial part for describing a part having four head modules for discharging liquid droplets of the same color in a ninth embodiment.
Figure 20:
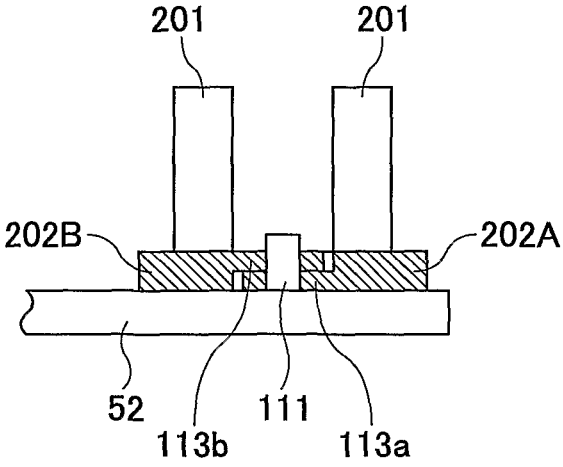
FIG. 20 is an enlarged side cross-sectional diagram of the head modules shown in FIG. 19.

Next, a ninth embodiment of the present invention is described with reference to FIGS. 19 and 20. FIGS. 19 and 20 are a schematic plan diagram and an enlarged side cross-sectional diagram of a substantial part of a recording head unit, respectively, for describing the ninth embodiment.

In this embodiment, a head 201 having nozzle arrays corresponding to one line is provided on each of head base members 202A and 202B. These two head base members 202A and 202B are positioned on a common array base member 203 by positioning pins 211 and 212 serving as the same reference members, which fit in positioning holes of the head base members 202A and 202B.

Figure 21:
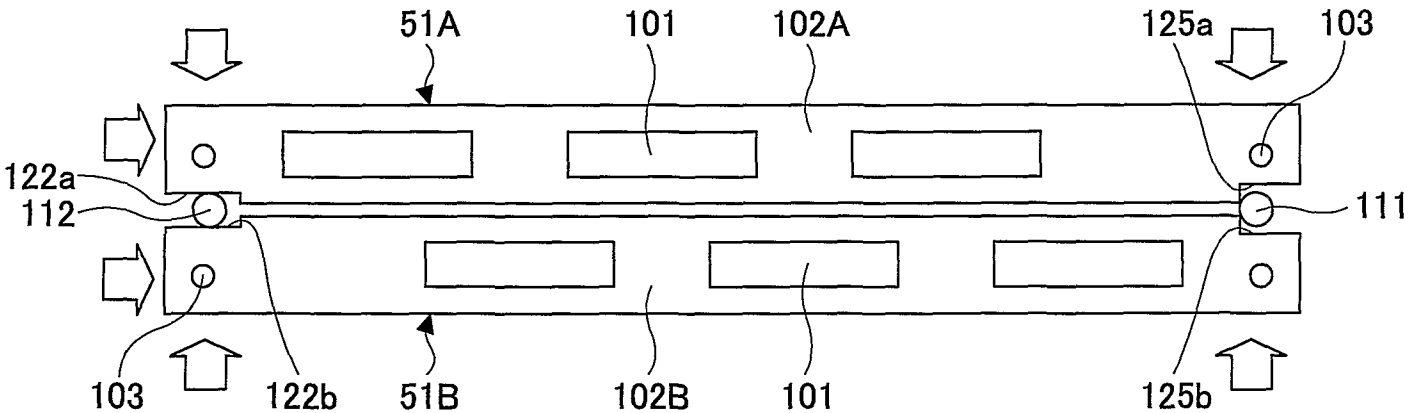
FIG. 21 is a schematic plan diagram showing a substantial part for describing a part having four head modules for discharging liquid droplets of the same color in a tenth embodiment.
Figure 22:
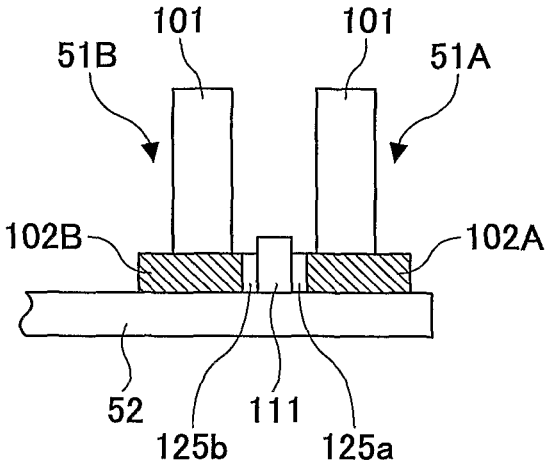
FIG. 22 is an enlarged side cross-sectional diagram of the head modules shown in FIG. 21.

Next, a tenth embodiment of the present invention is described with reference to FIGS. 21 and 22. FIGS. 21 and 22 are a schematic plan diagram and an enlarged side cross-sectional diagram of a substantial part of a recording head unit, respectively, for describing the tenth embodiment.

In this embodiment, in the configuration of the second embodiment, positioning recession parts (notch parts) 125*a* and 125*b* are formed instead of the V-shaped positioning grooves 121*a* and 121*b* on the side contacting the positioning pin member 111 of each of the module base members 102A and 102B, respectively. By a biasing member which is not shown, the module units 51A and 51B are biased with pressure in directions of hollow arrows in the longitudinal direction.

According to the image forming apparatus of one embodiment of the present invention, two or more head modules for discharging liquid droplets of the same color are positioned by the same reference member to be arranged on an array base member. Therefore, the plural head modules can be positioned with a high precision and replacement on a head module by head module basis, that is, in a module level can be performed without being influenced by a positional precision of the reference member.

According to the image forming apparatus of one embodiment of the present invention, two or more heads for discharging liquid droplets of the same color are positioned by the same reference member to be arranged on an array base member. Therefore, the plural heads can be positioned with a high precision and replacement on a head by head basis, that is, in a head level can be performed without being influenced by a positional precision of the reference member.

Further, the present invention is not limited to these embodiments, but variations and modifications may be made without departing from the scope of the present invention.

The present application is based on Japanese Priority Application No. 2008-189184 filed on Jul. 22, 2008, with the Japanese Patent Office, the entire contents of which are hereby incorporated by reference.

The invention claimed is:

1. An image forming apparatus comprising:

a common array base member; and plural head modules each formed of a module base member and plural heads configured to discharge liquid droplets in a liquid droplet discharging direction and arranged in an array on the module base member, the plural head modules being attached on the common array base member, wherein for each particular head module amongst the plural head modules, the particular head module and the common array base member are disposed one on the other, in a layered manner, in the liquid droplet discharging direction, the plural head modules are arranged in an array in a paper transfer direction that is perpendicular to a longitudinal direction of each of said head modules;

the heads of at least two of the head modules discharge liquid droplets of the same color; and the at least two of the head modules are positioned relative to a same reference point provided by a reference member on the common array base member.

2. The image forming apparatus as claimed in claim 1, wherein the at least two of the head modules are detachably attached on the common array base member and have no overlapped parts with each other in a direction in which the at least two of the head modules are detached.

3. The image forming apps med in claim 1, wherein the reference member is a pin member provided on the common array base member.

4. The image forming apparatus as claimed in claim 1, wherein the module base members of the at least two of the head modules have the same shape.

5. The image forming apparatus as claimed in claim 1, wherein the reference member is arranged between the at least two of the head modules for discharging the liquid droplets of the same color, and the head modules are arranged in the array in the paper transfer direction that perpendicular to the longitudinal direction of the each of the head modules.

6. The image forming apparatus as claimed in claim 1, wherein portions of the respective module base members of two or more head modules amongst the plural head modules overlap and are mutually layered one on the other in the liquid droplet discharging direction.

7. The image forming apparatus as claimed in claim 1, wherein said each head module amongst the plural head modules is attached in the liquid droplet discharging direction to the common array base member.

8. An image forming apparatus comprising:

a common array base member; and plural heads configured to discharge liquid droplets in a liquid droplet discharging direction and arranged on plural head modules attached on the common array base member, wherein for each particular head module amongst the plural head modules, the particular head module and the common array base member are disposed one on the other, in a layered manner, in the liquid droplet discharging direction, at least two of the heads arranged linearly in a paper transfer direction discharge liquid droplets of the same color, the paper transfer direction being perpendicular to a longitudinal direction of each of the head modules; and the at least two of the heads are positioned relative to a same reference point provided by a reference member on the common array base member, the reference member being disposed on the common array base member.

9. The image forming apparatus as claimed in claim 8, wherein the reference member is arranged between at least two of the head modules, and the head modules are arranged in the array in the paper transfer direction that is perpendicular to the longitudinal direction of the each of the head modules.

* * * * *